US006530425B2

(12) United States Patent
Wehrmann et al.

(10) Patent No.: US 6,530,425 B2
(45) Date of Patent: Mar. 11, 2003

(54) PLATE HEAT EXCHANGER

(75) Inventors: Reinhard Wehrmann, Reutlingen (DE); Klaus Feldmann, Neckartailfingen (DE); Ralf Beck, Reutlingen (DE); Jens Nies, Holzgerlingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/846,629

(22) Filed: May 1, 2001

(65) Prior Publication Data

US 2001/0054501 A1 Dec. 27, 2001

(30) Foreign Application Priority Data

May 3, 2000 (DE) ..... 100 21 481

(51) Int. Cl.[7] ..... F28F 3/08
(52) U.S. Cl. ..... 165/167; 165/166
(58) Field of Search ..... 165/166, 167, 165/152, 153, 916; 123/196 AB, 41.33; 180/104.3

(56) References Cited

U.S. PATENT DOCUMENTS 4,815,532 A * 3/1989 Sasaki et al. ..... 165/152
5,014,775 A * 5/1991 Watanabe ..... 165/51
5,193,611 A * 3/1993 Hesselgreaves ..... 165/165
5,307,869 A * 5/1994 Blomgren ..... 165/167
5,462,113 A * 10/1995 Wand ..... 165/140
5,964,280 A * 10/1999 Wehrmann et al. ..... 165/167
6,082,449 A * 7/2000 Yamaguchi et al. ..... 165/916
6,164,371 A * 12/2000 Bertilsson et al. ..... 165/167

FOREIGN PATENT DOCUMENTS

| | | |
|---|---|---|
| AT | 149253 | 4/1937 |
| EP | 0183007 | 6/1986 |
| EP | 0258236 | 10/1990 |
| EP | 0819907 | 8/1999 |

* cited by examiner

*Primary Examiner*—Henry Bennett
*Assistant Examiner*—Terrell McKinnon
(74) *Attorney, Agent, or Firm*—Wood, Phillips, Katz, Clark & Mortimer

(57) ABSTRACT

A plate heat exchanger that is provided with an internal insert located between plates that form a channel. The insert takes the form of an additional plate that has guide channels with at least one inlet and one outlet which lead from one flow channel of one medium to another flow channel of the same medium. Sections of the additional plate that are free of guide channels are metallically connected to an adjacent heat exchanger plate. The guide channels are metallically connected to the other adjacent heat exchanger plate of the same channel.

20 Claims, 4 Drawing Sheets

25
20
40c
40d
16
24
8f
17
8e
21c
21d
10
21b
8a
8b
8g
8c
8h
3
3
8i
8m
11a
8j
11b
13
8k
8L
10a
30
9
21a
9a
2
40a
18
40b
9
6
6
15
22
8g
21
14c
14b
14a
20a
8d
23

PLATE HEAT EXCHANGER

RELATED APPLICATIONS

This application claims priority to German Patent Application No. 100 21 481.9 filed May 3, 2000.

FIELD OF THE INVENTION

The present invention relates to an improved plate heat exchanger for heat exchanging media in separate loops of the heat exchanger wherein heat exchanger plates are stacked one upon the other and are metallically connected. The stacked plates each have openings disposed in a vertical manner to form flow channels for other medium/media. These flow channels are separate from each other and each is in fluid communication with channels between individual heat exchanger plates to thereby define separate loops each of which consists of flow channels interconnected by channels between the heat exchanger plates. At lease some of the channels between the plates are equipped with an internal insert.

BACKGROUND OF THE INVENTION

Plate type heat exchanger technology is a well developed field where the basic structure of stacked heat exchange plates with multiple vertical medium/media flow channels into and out of the heat exchanger are common. It appears that many improvements in this technology involve the manner in which the heat exchanger plates are constructed to provide horizontal channels between the plates that interconnect the various vertical flow channels. An example of this is found in some plate heat exchangers where knobs or similar protrusions are embossed in the heat exchanger plates that form the horizontal channels for heating or cooling medium. These knobs of adjacent heat exchanger plates are in contact and soldered to each other in order to increase the strength of the plate heat exchanger. Such knobs have proven themselves in general and are therefore employed frequently because they cause almost no detectable pressure loss. However, it appears that the useful life of heat exchangers embodying such knobs where extreme loads, both from temperature shock and extreme vibrations related to operation, is not always adequate. In other heat exchangers of the plate type in order to increase the strength and useful life relative to load, temperature shock and vibration, the heat exchanger is provided with thicker outer support plates which serve as an upper and lower cover plate between which there is situated corrugated heat exchanger plates. An increased useful life for the heat exchanger is derived from this structure, but only between the aforementioned plates and the corrugated heat exchanger plates. A similar problem is found in another such heat exchanger in which a reinforcement plate is provided with an edge inserted between a base plate and a lower most heat exchanger plate. In this heat exchanger environment, loads which also act in the interior of the plate heat exchanger cannot be countered by simply employing heat exchanger plates with knobs or using a reinforcement plate.

It is against this background that the instant invention effectively overcomes the problems just described, in a manner that is readily fabricated and significantly improves the state of the art.

SUMMARY OF THE INVENTION

The plate heat exchanger embodying the invention provides a greatly increased structural strength in the interior of the heat exchanger but above all the internal structure produces turbulence in the medium brought about by securing inserts in channels between the exchanger plates which are soldered to the heat exchanger plates. The turbulence enhancing inserts of the invention, which also minimize pressure loss of medium flowing through the channels, take a structural form of an additional plate that cooperates with adjacent heat exchanger plates to create guide channels with at least one inlet and one outlet which lead from a flow channel of one medium to another flow channel of the same medium, in which sections of the additional plate that are free of guide channels are metallically connected to an adjacent heat exchanger plate and the guide channels are metallically connected to the other adjacent heat exchanger plate of the same channel.

A primary object of the invention consists of improving the useful life of the interiors of plate heat exchangers without significantly increasing pressure loss of medium flowing through channels between heat exchanger plates. This is accomplished by an additional plate that has guide channels with at least one inlet and one outlet, which lead from one flow channel of one medium to the other flow channel of the same medium.

Another object of the invention is to provide increased turbulence in the medium as the medium flows through a channel between adjacent heat exchanger plates, by the provision of a guide channel between the plates wherein the addition plate that includes the guide channel includes sections of the additional plate and guide channels that are metallically connected to an adjacent heat exchanger plate and the guide channels are additional metallically connected to the other adjacent heat exchanger plate of the same channel.

Yet another object of the invention is to provide a plate heat exchanger that produces very limited pressure loss by means of the inclusion of guide channels that have at least one inlet and one outlet wherein there is an alignment of a number of guide channels from one flow channel to the other.

Still yet another object of the invention is to provide a plate heat exchanger that has a significantly improved useful life relative to temperature shock and extreme alternating temperature loads, as well as mechanical stress because the additional plate is connected on both sides to adjacent heat exchanger plates wherein connection surfaces are very large.

A still further object of the invention is to provide a plate type heat exchanger that is nearly cubic in shape which has pairs of flow channels for different mediums in opposing covers wherein guide channels between flow channels in heat exchanger plates can run arc like and into and around flow channels in corners of the heat exchanger.

Another object of the invention is to create a highly efficient plate heat exchanger wherein additional plates that include guide channels are located in all of its channels.

A major object of the invention which dramatically diminishes pressure loss resides in the provision of two irregular shaped openings in the additional plate which are adapted to the arrangement of guide channels that interconnect flow channels wherein the openings are larger than corresponding flow channel openings in the heat exchanger plates.

Another object of the invention is to provide the irregular openings in additional plates wherein the irregular openings include indentations in a direction toward inlet or outlets of selected guide channels thereby greatly increasing heat exchanger efficiency.

BRIEF DESCRIPTION OF THE DRAWINGS

The present invention is further described in the detailed description which follows in reference to the noted plurality of drawings by way of non-limiting examples of embodiments of the present invention in which like reference numerals represent similar parts throughout the several views of the drawing wherein.

DETAILED DESCRIPTION OF THE INVENTION

Figure 1:
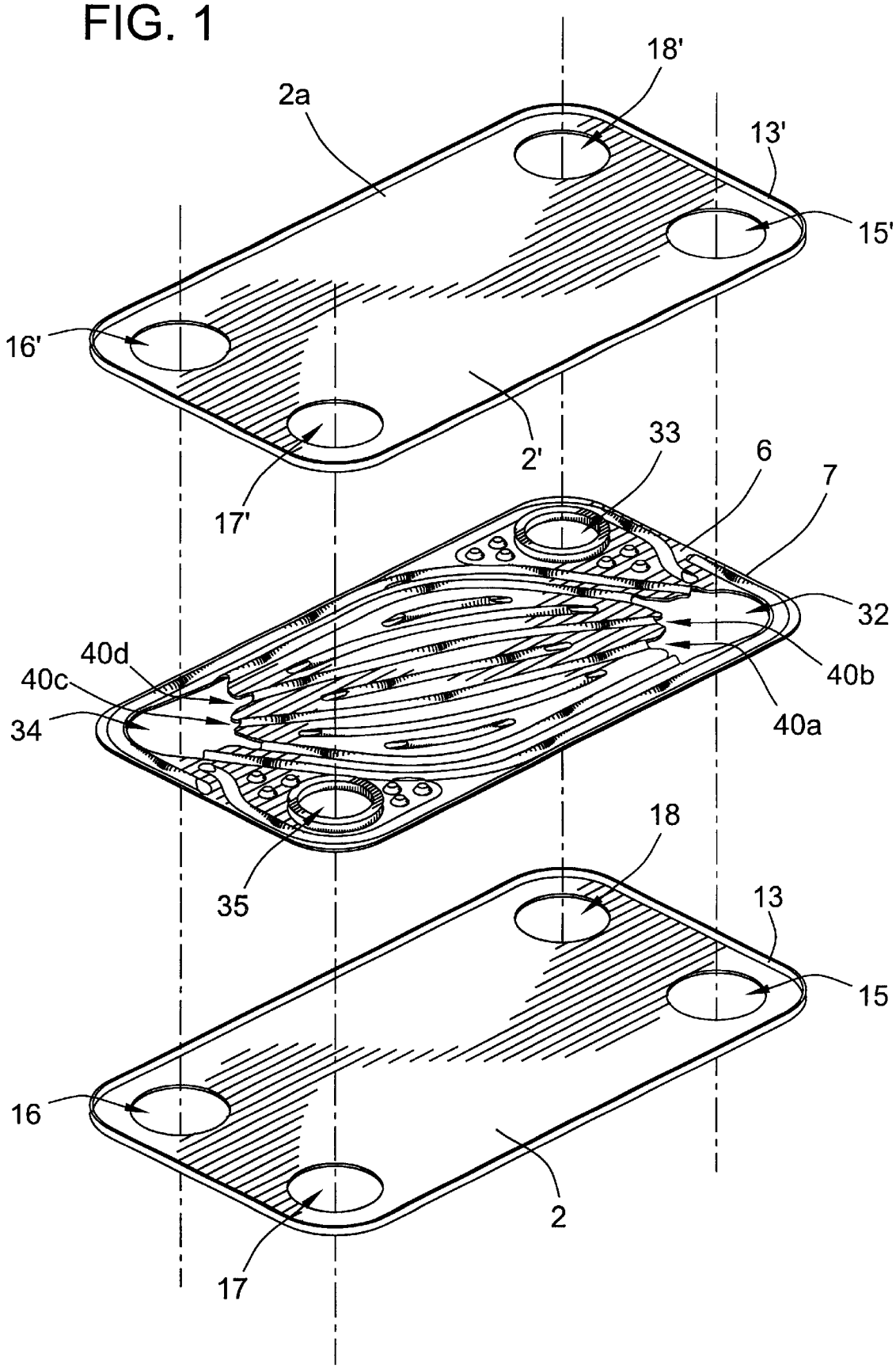
FIG. 1 is an exploded view of heat exchanger plates and an additional insert plate that when assembled establish a channel between the plates.

Reference is now made to FIG. 1 which illustrates the three major components of each channel of a plate type heat exchanger embodying the invention. In the description that follows and in the balance of this specification and appended claims the following terms will be employed to explain various basic components involved in the invention. Accordingly, the phrase "flow channel" will be employed to describe the pathway for either heating or cooling medium in the heat exchanger whereas the term channel will refer to a space between adjacent plates of the heat exchanger. It will be noted that FIG. 1 is an exploded view that is divided into an upper, middle and bottom portions of a heat exchanger plate assembly embodying the invention. In the bottom portion of FIG. 1 there is depicted a heat exchanger plate 2 of the general configuration shown. The plate 2 is provided with flow channel openings 15, 16, 17, and 18. The flow channel openings 15 and 16 are shown diagonally across from each other in opposite corners of the plate 2 as are flow channels 17 and 18. The perimeter of the plate 2 is provided with a raised edge 13 the detailed nature and function of which will become apparent as a description of subsequent figures unfolds. In the top portion of FIG. 1 an adjacent heat exchanger plate 2*a* is shown with flow channel openings 15', 16' and 17', 18' positioned as shown. The outer edge of the plate 2*a* also includes a raised edge 13'. The physical cooperation of the plates 2 and 2*a* will best be appreciated in an explanation that follows.

The middle portion of FIG. 1 shows an additional plate 6 which has an edge 7 that is smooth. The overall dimensions of additional plate 6 are such that it fits precisely between the two heat exchange plates 2, 2*a* in the manner shown in FIG. 5.

Figure 7:
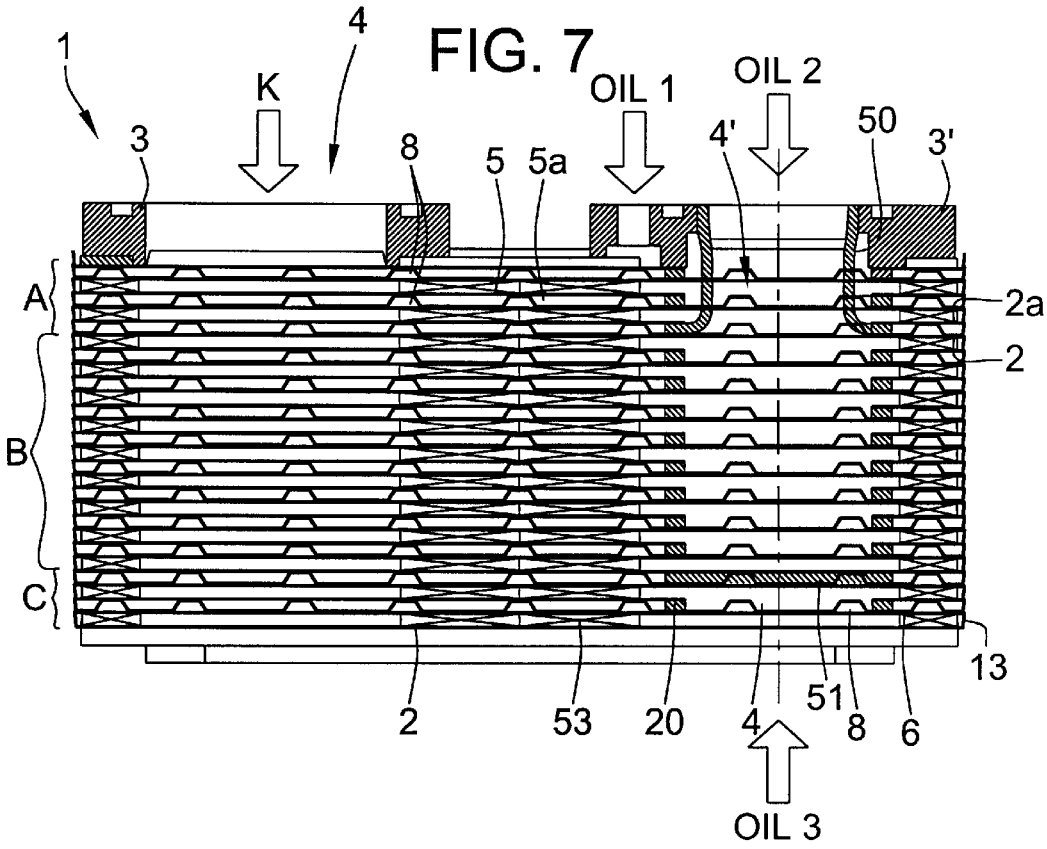
FIG. 7 is a cross-section of a plate heat exchanger that is provided with additional plates.
Figure 8:
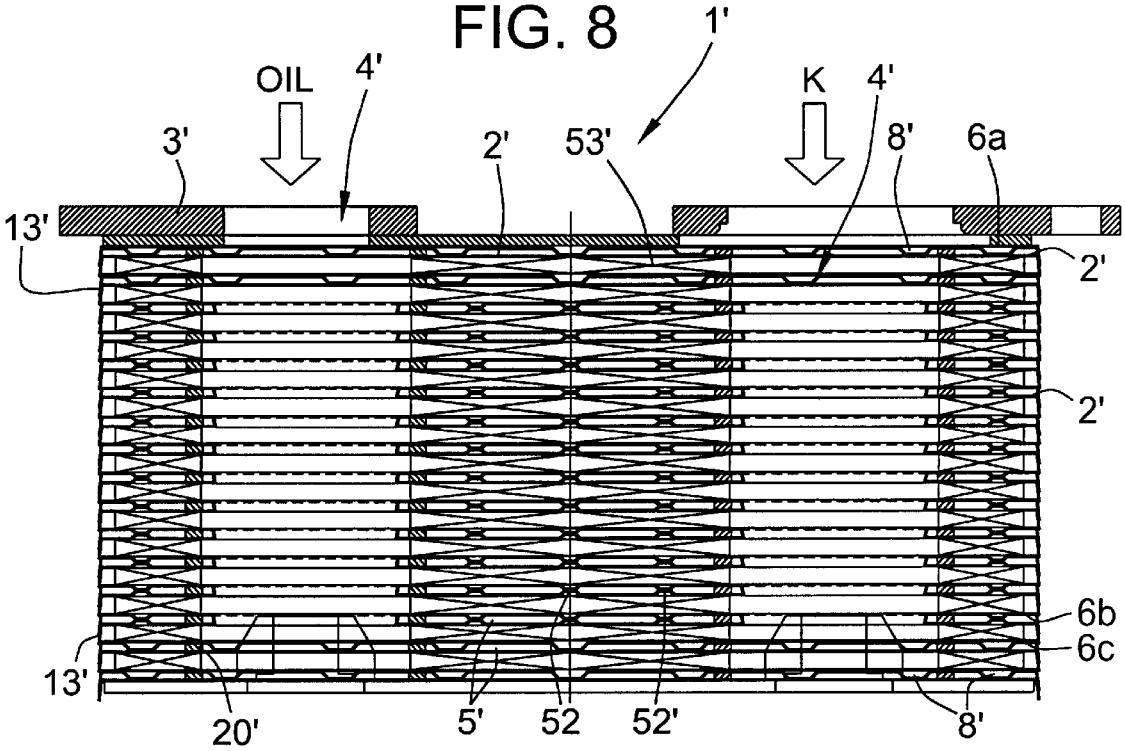
FIG. 8 is similar to FIG. 7 in that it depicts another embodiment of the invention.

The additional plate 6 has openings 32, 34 which align with the plate openings 15, 16 and 15', 16' and create, when assembled, flow channels 4 that pass vertically through a heat exchanger 1 as shown in FIGS. 7 and 8. The additional plate openings 33, 35 align with plate openings 17, 17' when assembled to provide a flow channel through all three plates to accommodate another medium in heat exchange of heating or cooling medium K of the nature shown in FIGS. 7 and 8.

The openings 32 and 34 are irregular in shape and include indentations 40*a*, 40*b* and 40*c*, 40*d*. The role and function of the openings 32, 34 and the indentations 40*a*, 40*b* and 40*c*, 40*d* will be explained in detail hereinafter.

Figure 2:
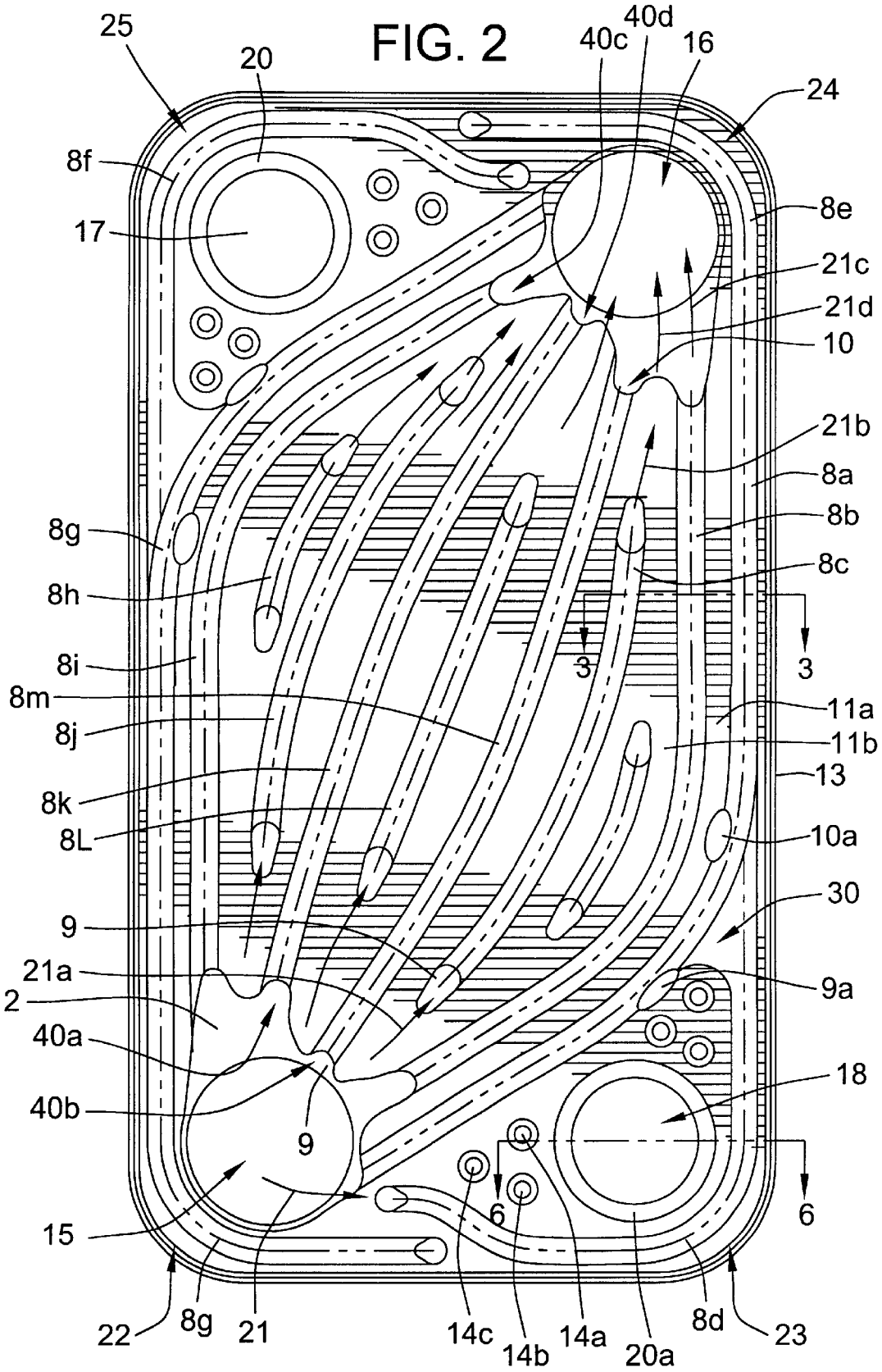
FIG. 2 is a top view of an assembly of the additional plate and a heat exchanger plate of FIG. 1 in which the additional plate is superimposed upon the heat exchanger plate.
Figure 3:
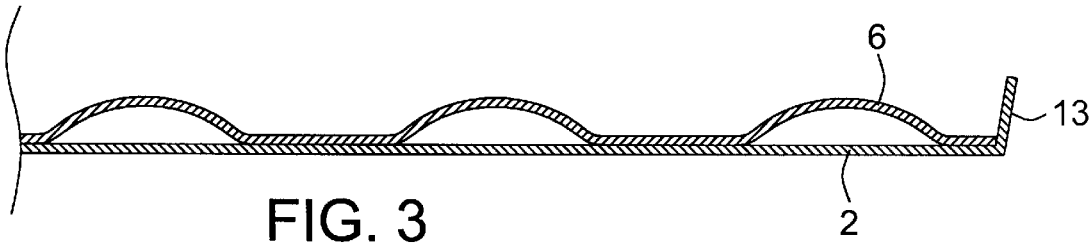
FIG. 3 is a cross-section along line 3—3 in FIG. 2.
Figure 3A:
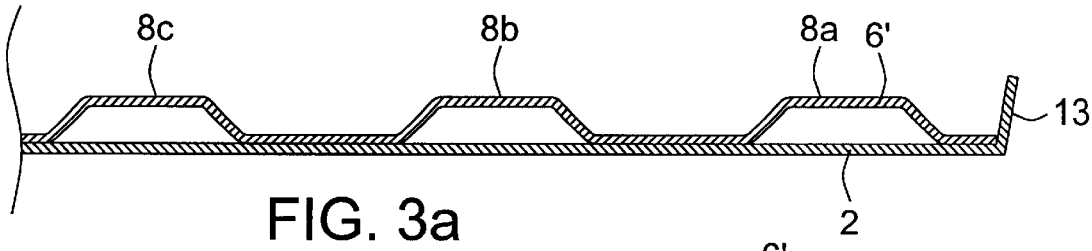
FIG. 3*a* is a cross-section similar to that shown in FIG. 3 in which an additional plate has a slightly modified configuration.

FIG. 3 is a cross-section taken along line 3—3 in FIG. 2 whereas FIG. 3*a* is a cross-section similar to that shown in FIG. 3 in which an additional plate 6' has a slightly modified configuration.

Figure 4:
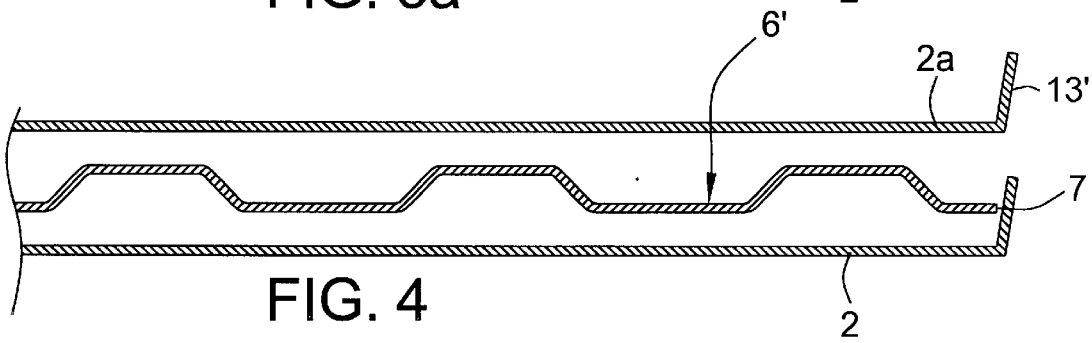
FIG. 4 is a cross-section of heat exchanger plates with an additional plate shown schematically therebetween and illustrates the nature of an assembly of plates and additional plate of the nature set forth in FIG. 1.
Figure 5:
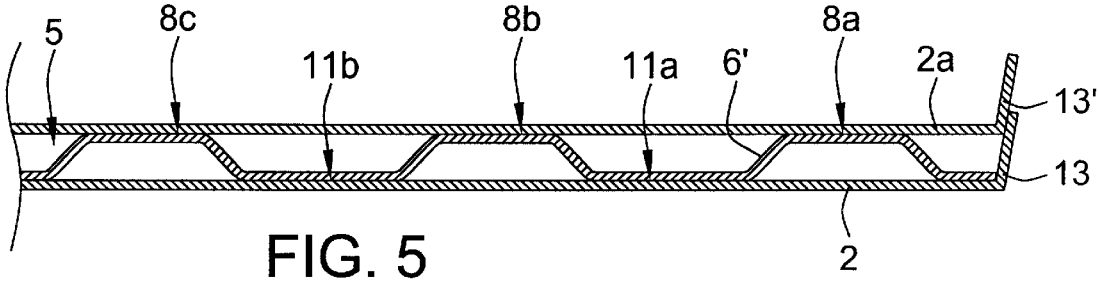
FIG. 5 depicts a cross-section of a portion of a heat exchanger channel that shows the relationship of heat exchanger plates to an additional plate interposed between the plates.

FIG. 4 illustrates in a cross-sectional manner the nature in which the plates 2, 2*b* and additional plate 6' of the nature just noted in FIG. 3*a* depicted and generally described in FIG. 1 as they would be arranged prior to final assembly. FIG. 5 illustrates a completed assembly of plates 2*a*, 2*b* with additional plate 6' inserted in between the plates. A channel 5 is present between the plates 2 and 2*a*. The additional plate 6' has been embossed to create the overall cross-sectional structure of guide channels 8*a*, 8*b*, 8*c* shown in this figure as well as FIG. 2. It should be understood that the invention is intended to include a variety of guide channel configurations each designed to accommodate the nature of the medium flowing in the channel/guide channel. The guide channels 8*a*, 8*b*, 8*c* take the form of elongated beads as is best appreciated by a study of FIG. 2. Accordingly, it will be observed that the embossed additional plate 6' structurally cooperates with the plates 2 and 2*a* to establish between the plates 2, 2*a* the channel 5 and guide channels 8*a*, 8*b* and 8*c*. Although not identified by reference numerals it is to be understood that wherever the embossed additional plate 6' comes into contact with the plates 2 and 2*a*, the plate is securely soldered to the plates.

Attention is now directed to FIG. 2 which is a top view of an assembly of the additional plate 6 and a heat exchanger plate 2, absent the plate 2*a* depicted in FIG. 1. A heating or cooling medium will enter channel as noted above between the plates 2, 2*a* from an opening 15 of a flow channel in corner region 22. The medium will then flow through all of the guide channels 8*a* through 8*k* as well as the space between the guide channels and heat exchanger plates and leave the channel 5 (see FIG. 5) again via the opening 16, i.e., the corresponding flow channel which is arranged in the diagonal corner region 24. The medium continues its flow through other channels in the heat exchangers as shown in FIGS. 7 and 8. Openings 17 and 18 of plate 2 which cooperate with openings 35 and 33 of the additional plate 6 have rings 20, 20*a* positioned as shown so that channel 5 from different media are separated from each other. The physical relationship of ring 20 and plates 2 and 2*a* can best be observed in FIG. 6. Instead of rings 20 collars (not shown) could also be formed in the opening at 17 and 18.

Turning again specifically to FIG. 2 it is apparent that there are a significant array of guide channels 8*a*, 8*b*, 8*c*, 8*d*, 8*e*, 8*f*, 8*g*, 8*j*, 8*k*, 8*l* and 8*m* disposed as shown in this figure. Typically a guide channel such as 8*c* have an inlet 9 and an outlet 19. The inlet 9 and outlet 10 are optimized with respect to flow and are roughly egg shaped, that is oblong in nature, so that a limited pressure loss is supported for corner region 22. In corner region 22 in the lower left hand corner of FIG. 2 the arrows 21 and 21 a show the path the heating or cooling medium takes as it exits a flow channel and flows through guide channel 8*d* and guide channel 8*c*. Note also in the upper right hand corner of FIG. 2 in the corner region 24 that flow arrows 21*b*, 21*c*, 21*d* show the flow of the medium into the flow channel at opening 16. Most guide channels are provided with a slight curvature. Some guide channels such as 8*k* and 8*m* connect openings 15 and 16 directly. Others are shorter and begin and end as can be seen in FIG. 2 with a certain spacing from openings 15 and 16. Note also that guide channels 8*d*, 8*e*, 8*f* and 8*g* are provided in each of the corner regions 23, 24, 25 and 22. A branch 30 is also provided between guide channels 8*d* and 8*a*. Free sections such as 11*a* and 11*b* between guide channels are soldered, as noted earlier, to plate 2 and the guide channels are soldered to the plate 2*a* not shown in the figure. This design ensures that the corner regions 22, 23, 24 and 25 participate intensely in heat exchange and establish excellent strength in the heat exchanger as a whole. In corner region 23 note also in the region of the branch 30, additional inlets and outlets 9, 10*a* which are provided in order to make the flow in this region more uniform. In corner regions 22 and 24 the irregular shaped openings 32 and 34 most easily seen in the center region of FIG. 1 include the indentations such as 40*a*, 40*b*, 40*c* and 40*d* which lead to inlets and outlets such as 9 and 10 of the longer guide channel 8*m*.

Figure 6:
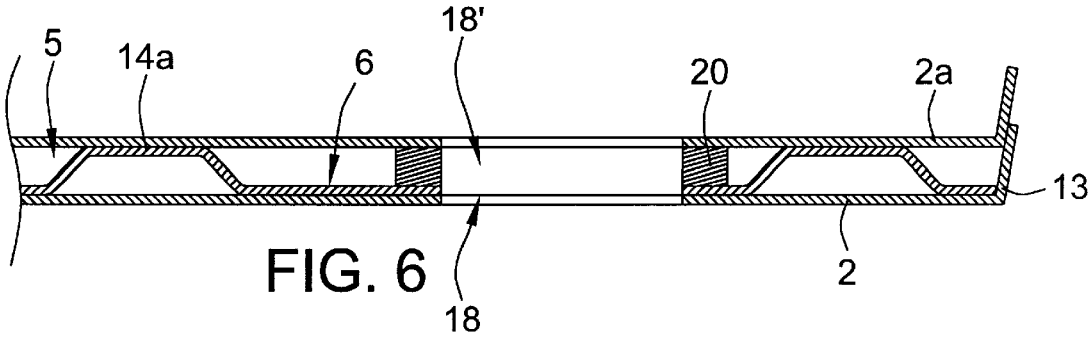
FIG. 6 depicts a cross-section taken along line 6—6 of FIG. 2 that has been modified to include a showing of a top heat exchanger plate and an additional plate of the type depicted in FIG. 3*a;*

In the lower right hand corner of FIG. 2 a set of three knobs 14*a*, 14*b*, 14*c*, one of which 14*a* is shown in section in FIG. 6, are shown arranged in the vicinity of corner region 23 and adjacent a flow channel defined by ring 20. The knobs 14*a*, 14*b*, 14*c* are soldered to the adjacent plate 2*a* as shown in FIG. 6. The undeformed region in the additional plate 6 around the flow channel openings in corner regions 23, 25 are strengthened by the knobs.

The configuration of the guide channels 8*a*, 8*b*, 8*c* which are illustrated in FIG. 5 are designed to be bead like in nature.

FIG. 7 and FIG. 8 are cross-sections of plate type heat exchangers 1 and 1' that embody the invention. A number of structural details inherent in the pair of heat exchanger plates having an additional plate between them and fully described herein before can be identified in these embodiments. In FIG. 7, the edge 13 of the plate heat exchanger 1 is shown directed upward. In FIG. 8 the heat exchanger 1' shows the edges 13' directed downward. The heat exchanger plates 2 in FIG. 8 and 2*a* in FIG. 7 are the only plates that are referenced. Typical of plate heat exchangers these two heat exchangers are comprised of heat exchanger plates stacked one upon the other. Both the heat exchangers of FIG. 7 and FIG. 8 represent practical examples of different variants of a retarder-oil-cooler, which are intended for use in trucks. These heat exchangers cool the truck's brake fluid. Extremely high oil temperatures of more than 200° C. occur in such oil coolers. An extensive series of experiments have demonstrated that operating conditions in such trucks create high temperature shock loads which prior art plate heat exchanger oil coolers are not able to handle.

In FIG. 8 the cross-section through the plate heat exchanger 1' depict a total of four separate loops. The flow channel 4 for the cooling or heating medium K is situated on the left side in both FIG. 7 and FIG. 8. On the right side, the flow channel 4' for oil 1, oil 2, and oil 3 are apparent. There are another two flow channels not shown for emergence of the media. The flow channels 4 and 5' have connection flanges 3 and 3'. The connection flange 3' for oil 1 has a connection channel (not shown) so that the oil 1 enters through this connection channel and is in heat exchange in upper channels such as 5 and 5*a* with the coolant K. All channels for oil 1, oil 2 and oil 3 have convention lamellae 53. The oil 2 also enters at connection flange 3' of the plate heat exchanger 1 through the tube piece 50 with a flange that is rigidly soldered between two heat exchanger plates 2 and 2*a*. The oil 3, on the other hand, is supplied or taken from the bottom of the plate heat exchanger 1. A baffle 51 is provided to keep oil 2 separate from oil 3 which is present in flow channel 4'.

In practice the heat plate exchanger of FIG. 7 includes in all the channels for the coolant K an additional plate 6 only one of which is referenced in FIG. 7. In another practical example (not shown), only the channels for coolant K, which are adjacent to the sections "a" for oil 1, "b" for oil 2 and "c" for oil 3 were equipped with additional plates of the type previously described.

FIG. 8 is another cross-section of a plate heat exchanger 1' with a loop for coolant K and an oil loop shown. Only the two upper and two lower channels 5', 5*a'* for the coolant K were provided with an additional plates 6*a*, 6*b*, 6*c*, because it turned out that the outer channels are exposed to the strongest temperature differences. The heat exchange plates referenced in other channels for coolant K were equipped as usual with knobs such as knobs 52, 52' which are in contact and soldered to each other.

Though the invention has been described with respect to preferred embodiments thereof; many variations and modifications will immediately become apparent to those skilled in the art. It is therefore the intention that the appended claims be interpreted as broadly as possible in view of the prior art to include such variations and modifications.

What is claimed is:

1. An improved plate heat exchanger for heat exchanging media in separate loops, wherein individual heat exchanger plates are stacked one upon the other and are metallically connected, the stacked plates each having openings that form flow channels for entry or discharge of a heating or cooling medium and other flow channels for other medium/media which are separate from each other and each is in fluid communication with channels between individual heat exchanger plates to thereby define separate loops consisting of flow channels interconnected by channels between the heat exchanger plates, the improvement comprising:

at least one pair of adjacent heat exchanger plates having disposed in a channel an additional plate that is integrally secured at various regions thereof to each one of the pair of heat exchanger plates, the additional plate and pair of heat exchanger plates physically cooperating to establish at least one separate guide channel within the channel that exists between the pair of heat exchanger plates, the guide channel having at least one inlet and one outlet.

2. The plate heat exchanger of claim 1 wherein the additional plate is provided with a plurality of guide channels brought about by the physical interaction of guide channel structure and the pair of heat exchanger plates.

3. The plate heat exchanger of claim 1 wherein the separate guide channel has the inlet near one of the flow channels and the exit near another flow channel, the flow channels and separate guide channel within a channel thereby defining a separate loop.

4. The plate heat exchanger of claim 3 wherein the additional plate includes irregular indented openings in communication with each of the flow channels to thereby minimize pressure loss.

5. The plate heat exchanger of claim 4 wherein an outer shape of the additional plate roughly corresponds to an outer shape of the heat exchanger plates.

6. The plate heat exchanger of claim 5 wherein the pair of heat exchanger plates and the additional plate each have at least an additional set of two openings, the openings in the additional plate and the openings in the heat exchanger plates are integrally secured to each other to thereby form flow channels for entry and discharge of medium through a channel between the heat exchanger plates and the additional plate, the flow channels and channels on either side of the pair of adjacent plates having the additional plate there between form another separate loop for heat exchanging medium.

7. The plate heat exchanger claim 2 wherein there is an alignment of guide channels from one flow channel to the other flow channel of the same medium to thereby provided a very limited pressure loss.

8. The plate heat exchanger of claim 7 wherein the additional plate and associated guide channels are integrally connected on both sides thereof to the pair of adjacent heat exchanger plates.

9. The plate heat exchanger of claim 6 wherein the plate heat exchanger is nearly cubic in shape and guide channels are arranged in corner regions as well as in an arc like array between flow channels.

10. The plate heat exchanger of claim 9 wherein additional plates having guide channels are provided in other channels.

11. The plate heat exchanger of claim 10 wherein each additional plate is integrally connected on both sides to the heat exchanger plates to provide large connection surfaces and thereby enhance the useful life of the heat exchanger.

12. The plate heat exchanger of claim 11 wherein indentations in the irregular openings in the additional plates are directed towards inlets or outlets of select guide channels.

13. The plate heat exchanger of claim 12 wherein some guide channels are provided with branches to thereby enhance flow and provide a uniform distribution of medium between adjacent heat exchanger plates.

14. The plate heat exchanger of claim 13 in which the guide channel branches are situated between an edge of a heat exchanger and a flow channel in corner regions where heat exchange plates participate intensely in heat exchange to thereby provided homogeneous distribution of heat exchange over all regions of the heat exchanger.

15. The plate heat exchanger of claim 14 wherein some of the guide channels are continuous from one flow channel to another flow channel, whereas other guide channels are much shorter and have their inlets and outlets separate from the flow channels.

16. The plate heat exchanger of claim 15 wherein the additional plates include protrusions that have a height that is the same as guide channel height.

17. The plate heat exchanger of claim 16 wherein the protrusions are arranged in the vicinity of flow channels and in the surfaces of additional plates were guide channels do not exist in significant numbers and thereby additionally support the additional plates in the vicinity of the flow channels.

18. The plate heat exchanger of claim 17 wherein the additional plates are significantly thinner than the heat exchanger plates.

19. The plate heat exchanger of claim 18 wherein the inlets and outlets of guide channels are oblong in shape.

20. The plate heat exchanger of claim 6 wherein the heat exchanger is provided with more than two mediums and the heat exchanger is provided with more than two flow channels and associated channels which are provided with additional plates and guide channels.

* * * * *